US005699913A

United States Patent [19]

Richardson

[11] Patent Number: 5,699,913

[45] Date of Patent: Dec. 23, 1997

[54] UNITIZED PACKAGE ASSEMBLY

[75] Inventor: Rebecca Kimbrell Richardson, Garland, Tex.

[73] Assignee: Cellstar, Ltd., Carrollton, Tex.

[21] Appl. No.: 565,159

[22] Filed: Nov. 30, 1995

[51] Int. Cl.[6] ..... B65D 73/00

[52] U.S. Cl. ..... 206/470; 206/471; 206/906; 206/459.5; 40/658; 40/666

[58] Field of Search ..... 206/736, 459.1, 206/459.5, 461, 467, 470, 471, 806; 40/661, 658, 666, 669, 617, 620, 622

[56] References Cited

U.S. PATENT DOCUMENTS

| | | | |
|---|---|---|---|
| 349,239 | 8/1886 | Steenland . | |
| 3,463,309 | 8/1969 | Szostek | 206/470 |
| 3,881,257 | 5/1975 | Chasen . | |
| 4,001,957 | 1/1977 | De Lima Castro | 40/661 |
| 4,016,972 | 4/1977 | Szamborksi . | |
| 4,165,572 | 8/1979 | Sussman | 40/661 |
| 4,168,002 | 9/1979 | Crosby . | |
| 4,211,329 | 7/1980 | Braverman . | |
| 4,449,629 | 5/1984 | Barrieau . | |
| 4,512,474 | 4/1985 | Harding . | |
| 4,666,037 | 5/1987 | Weissman | 206/470 |
| 4,739,883 | 4/1988 | Mohs et al. . | |
| 5,121,835 | 6/1992 | Grupe . | |
| 5,148,618 | 9/1992 | Brewster | 40/661 |
| 5,263,586 | 11/1993 | Keable | 206/461 |
| 5,293,993 | 3/1994 | Yates, Jr. et al. | 206/471 |
| 5,497,882 | 3/1996 | Kenyon | 206/461 |
| 5,540,324 | 7/1996 | Knapp | 206/461 |
| 5,593,036 | 1/1997 | Dyble et al. | 206/470 |

*Primary Examiner*—Jimmy G. Foster
*Assistant Examiner*—Nhan T. Lam
*Attorney, Agent, or Firm*—Daniel N. Lundcen; Sroufe, Payne & Lundcen L.L.P.

[57] ABSTRACT

A unitized package assembly for holding and containing merchandise for transport to and display at a point of sale. The assembly includes a header and a plurality of articles suspended therefrom. Each article is secured to the header by a projection on the header which passes through an aperture in a tab that extends from each article. Each projection, located on a back panel of the header, is interlocked with a matching indent, located on a front panel of the header, and the tab is sandwiched between the projection and indent, securing the tab, and thus the article, to the header, The header also holds a printed sheet and has a hole for receiving a hook so that the assembly can be hung for display at a point of sale.

10 Claims, 3 Drawing Sheets

UNITIZED PACKAGE ASSEMBLY

FIELD OF THE INVENTION

The present invention relates to packaging of merchandise, particularly packaging of relatively small goods for transport and display.

BACKGROUND OF THE INVENTION

Goods or merchandise sold in the retail market are typically packaged for containerization, efficiency of transport and storage, and display at a point of sale. Paper or cardboard boxes have often been used as packages, providing a good container, but no view of the merchandise within. The contents of a paper or cardboard package are often depicted pictorially by placing on the outside a picture or illustration of the merchandise within. Purchasers frequently prefer to open the package to view the merchandise within.

When multiple and optional components are involved, packaging is more complicated. The multiple components are often packaged together in a box, usually with a packing material for cushioning. Purchasers cannot view the merchandise within, and little flexibility is provided for modifying the combination of optional components.

Further complications arise where several optional components are manufactured and stored in various locations remote to the final packaging of the assembly of components. The individual components have to be adequately packaged for shipment to a location designated for final packaging of the assembly of components. The individual components may have to be unpacked from one carton and repacked in another.

In recent years, small goods have often been packaged in clear plastic containers, providing a display with a view of the merchandise within the package. In U.S. Pat. No. 4,739,883, Mohs et al. discloses a reclosabled display package of thin flexible thermoformed plastic material and an inscription card enclosed therein. The Mohs et al. device provides a single compartment container for articles. In U.S. Pat. No. 4,449,629, Barrieau discloses a display and storage container for multiple tool parts and the like. The Barrieau device provides a single integrated container with multiple compartments for articles.

Many packages and containers exist in the prior art, but there remains a need for a package suitable for multiple articles that provides flexibility for combining objects for containerization, storage, shipment and display. The containerization or packaging of individual objects should be simple and inexpensive. Individually packaged objects should be storable, shipable, and easy to assemble into a multiple-object package. A multiple-object package should be storable, shipable, and ready for display at a point of sale.

SUMMARY OF THE INVENTION

The present invention provides containerization or packaging of articles or components that is relatively simple and inexpensive. These containers or packages can be stored or transported with their articles or components containerized or packaged. Different combinations of articles or components can be assembled relatively easily into a multiple-object package, which can be transported to and displayed at a point of sale.

The present invention provides a unitized package assembly, comprising a header including front and back panels extending downwardly from an upper flange to a lower flange. A plurality of projections are formed in the lower flange of the back panel of the header, and indents are formed in the lower flange of the front panel to correspond with and receive the projections in locking engagement therewith. A plurality of articles depend from the header, and a tab extends from each of the articles. The tab includes an aperture for receiving therethrough one of the projections from the lower flange of the back panel of the header to secure the tab extending from the article between the front and back panels.

The upper flanges of the front and back panels preferably have corresponding holes for receiving a display hook, and the holes can be adapted to center the unitized package assembly on the hook.

In a preferred embodiment, a printed sheet is held between the front and back panels of the header. The front and back panels preferably have corresponding interengageable raised surfaces to define an enclosure between the upper and lower flanges to secure the printed sheet. The engagement of the raised surfaces can lock the front panel to the back panel, and preferably a hinge connects the front and back panels of the header along an outer edge of the upper flanges.

The projections, indents, and apertures can be correspondingly shaped to restrict any pivoting of the tab about the projection and are preferably horizontally elongated. The articles are preferably containers for displaying merchandise.

In another aspect, the present invention provides a header for hanging merchandise from a display hook. The header comprises front and back panels having opposing upper and lower flanges; a first raised surface formed in the back panel between the upper and lower flanges; a second raised surface formed in the front panel having a contour for matingly receiving the first raised surface; and a printed sheet secured between the first and second raised surfaces.

A projection is formed in the lower flange of the back panel, and a corresponding detent is formed in the lower flange of the front panel for receiving the projection and interlocking the front panel with the back panel. The projection and detent are adapted for hanging an article having a tab apertured to receive a projection therethrough with the tab held between the flanges.

The header has corresponding holes formed in the back and front panels for receiving the display hook and hanging the header therefrom. The holes are preferably adapted to center the header on the hook.

The projections, detents, and apertures can be noncircularly shaped, preferably horizontally elongated, to inhibit pivoting of the tab about the projection. A hinge preferably connects the front and back panels at an outer edge of their upper flanges.

DETAILED DESCRIPTION OF THE INVENTION

Figure 5:
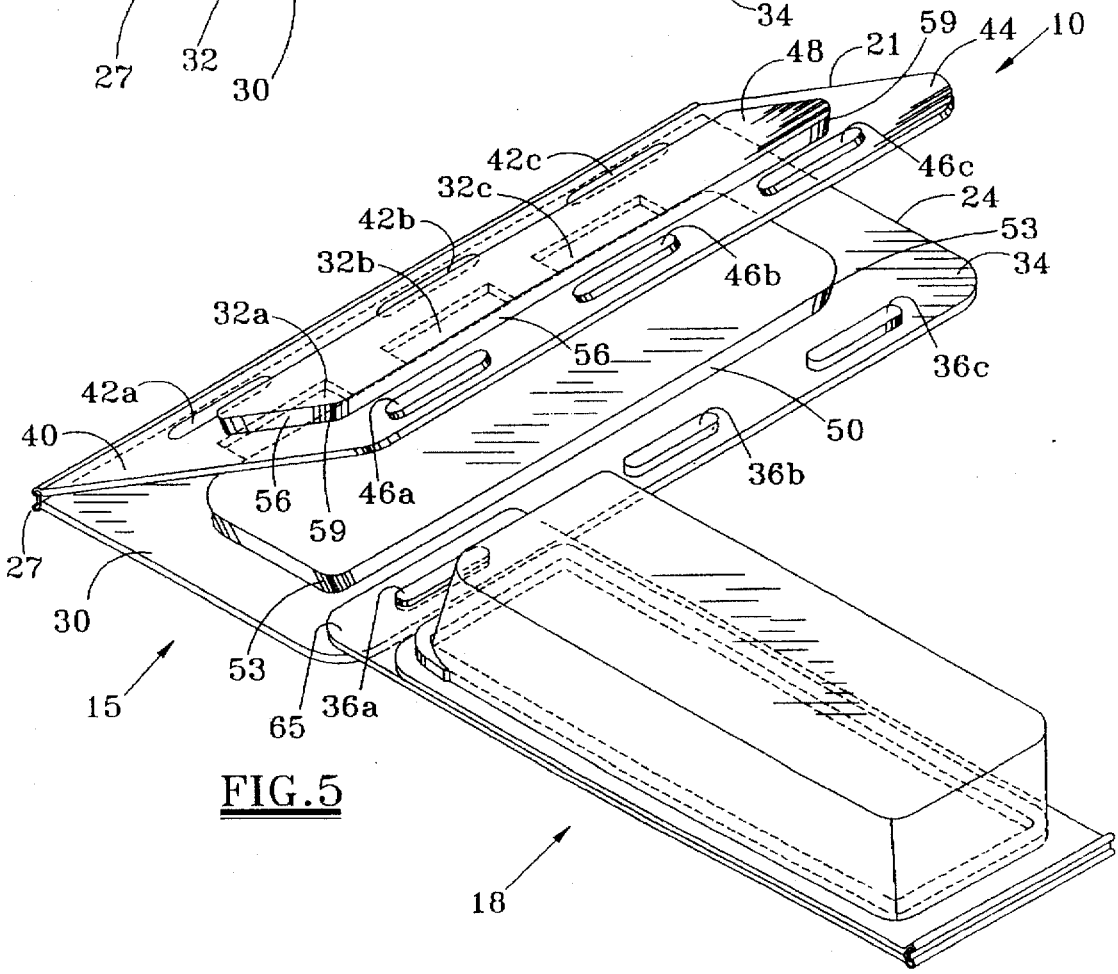
FIG. 5 is a perspective view of the header of FIG. 1 in an open position and the article of FIGS. 2–4 in a closed position.

A unitized packaging assembly 10 includes a header 15 and at least one article 18, as shown in FIG. 5. For simplicity and convenience regarding numeric identifiers, as used in this description, where there is a multiple occurrence of a single element, an alpha character is added to the numeric identifier as a suffix. Thus, in FIG. 6 the three articles 18*a*, 18*b*, and 18*c* shown are equivalent to the single article 18 shown in FIG. 5.

The header 15 has a front panel 21 and a back panel 24, both of which have a generally rectangular shape, although other shapes can be used. The front panel 21 and back panel 24 are preferably, but not necessarily, joined by a hinge 27, as shown in FIG. 1.

Figure 1:
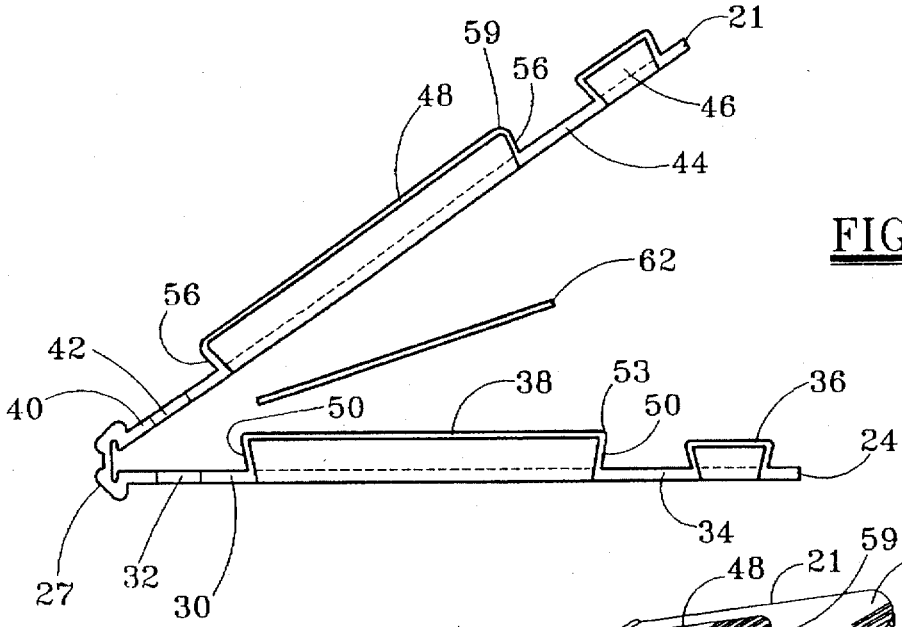
FIG. 1 is a cross-sectional view of a header according to one embodiment of the present invention.

As best seen in FIG. 1, the back panel 24 has an upper flange 30 which has at least one hole 32 for receiving a display hook as described in more detail below. The back panel 24 has a lower flange 34 which has at least one and preferably a plurality of projections 36. The back panel 24 has a raised surface 38 formed between the upper flange 30 and the lower flange 34.

Similarly, the front panel 21 has an upper flange 40 which has a hole 42 corresponding to the hole 32. The front panel 21 has a lower flange 44 which has at least one indentation or indent 46. The front panel 21 has at least one raised surface 48 formed between the upper flange 40 and the lower flange 44.

Figure 6:
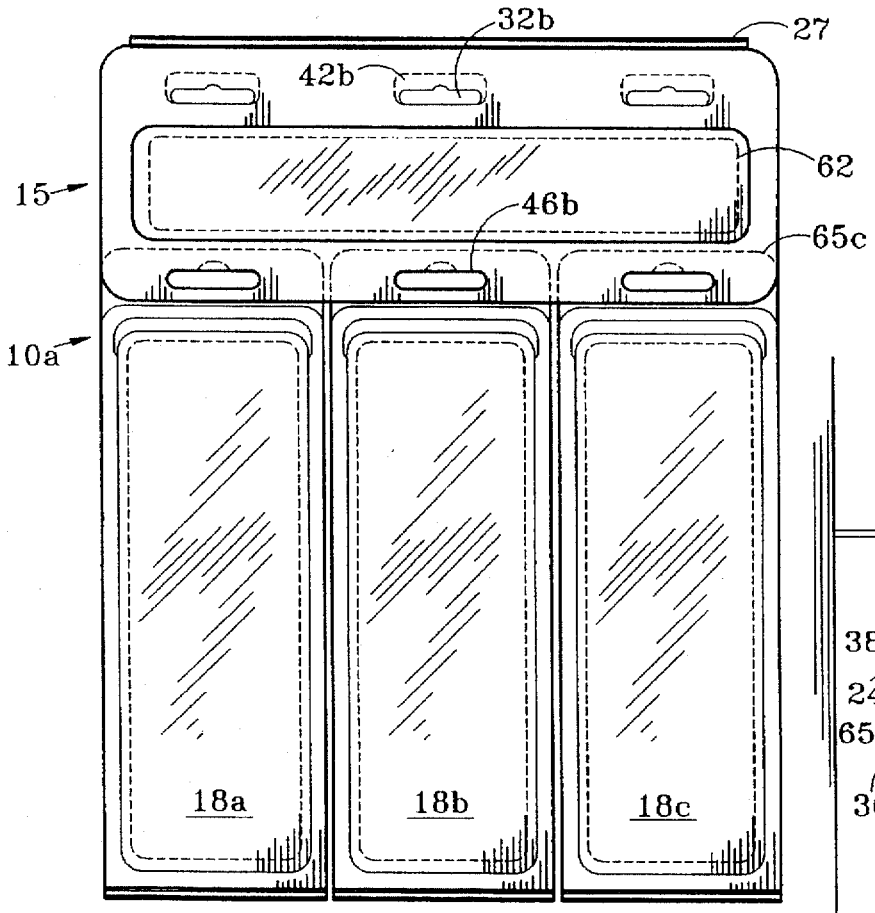
FIG. 6 is an elevation view of a unitized package assembly comprising the header of FIG. 1 and the articles of FIGS. 2–4.
Figure 7:
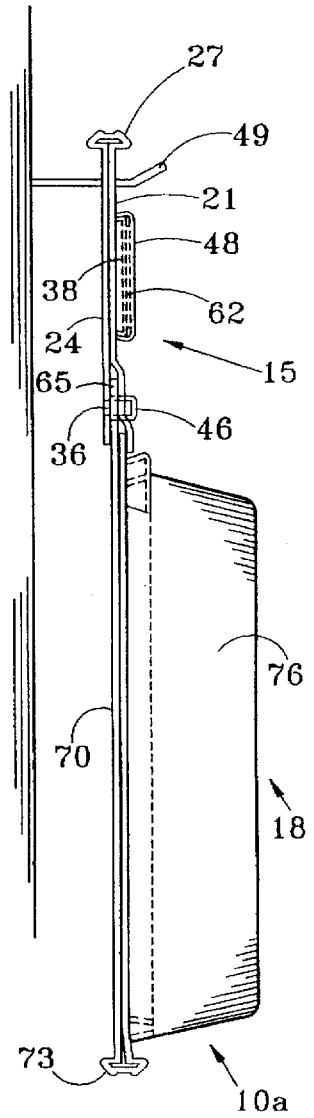
FIG. 7 is a side view of the unitized package assembly of FIG. 6 hanging on a display hook.

As best seen in FIGS. 5–7, the elements of the front panel 21 generally align with and correspond to the elements of the back panel 24. The holes 42*a*, 42*b*, and 42*c* in the front panel 21 align with the holes 32*a*, 32*b*, and 32*c* in the back panel 24, respectively, so that a display hook 49 can pass through a pair of holes such as 32*b* and 42*b*. The holes 32 and 42 are adapted to center the header 15 on the hook 49.

The indents 46*a*, 46*b*, and 46*c* in the front panel 21 align with the projections 36*a*, 36*b*, and 36*c* in the back panel 24 and serve as detents to lock the front panel 21 to the back panel 24. The second raised surface 48 in the front panel 21 aligns with and snaps onto the first raised surface 38 in the back panel 24, locking the front panel 21 onto the back panel 24. Given a certain number of elements in the back panel 24, a similar number of elements is provided in the front panel; for example, if three projections 36 are provided in the back panel 24, then three detents or indents 46 are provided in the front panel 21.

The projections 36 and the indents 46 are shaped and sized to interlock the front and back panels 21, 24. As best seen in FIG. 1, the projections 36 and the indents 46 are flared outwardy so that the indents 46 stretch slightly and snap over the projections 36 when pressed together.

Similarly, the first and second raised surfaces 38, 48 are shaped and sized to interlock the front and back panels 21, 24. The first raised surface 38 is attached to the back panel 24 by walls 50 having preferably rounded corners 53, as shown in FIGS. 1 and 5. Although the walls 50 are generally perpendicular to the back panel 24, in the proximity of the corners 53, the walls 50 are preferably flared outwardly. Likewise, the second raised surface 48 is attached to the front panel 21 by sides 56 having corners 59. The sides 56 are flared outwardly adjacent the corners 59, but are generally perpendicular to the front panel 21 elsewhere. When the second raised surface 48 is pressed against the first raised surface 38, the sides 56 expand and/or the walls 50 contract, and the second raised surface 48 snaps into position over the first raised surface 38, interlocking the front panel 21 with the back panel 24.

A printed sheet 62, displaying text and/or graphics for display at a point of sale, is held between the first and second panels 21, 24 in the enclosure defined by the first raised surface 38, the second raised surface 48, and the sides 56. If desired, merchandise can be contained in this enclosure by altering the dimensions of the enclosure to accommodate the merchandise.

Figure 3:
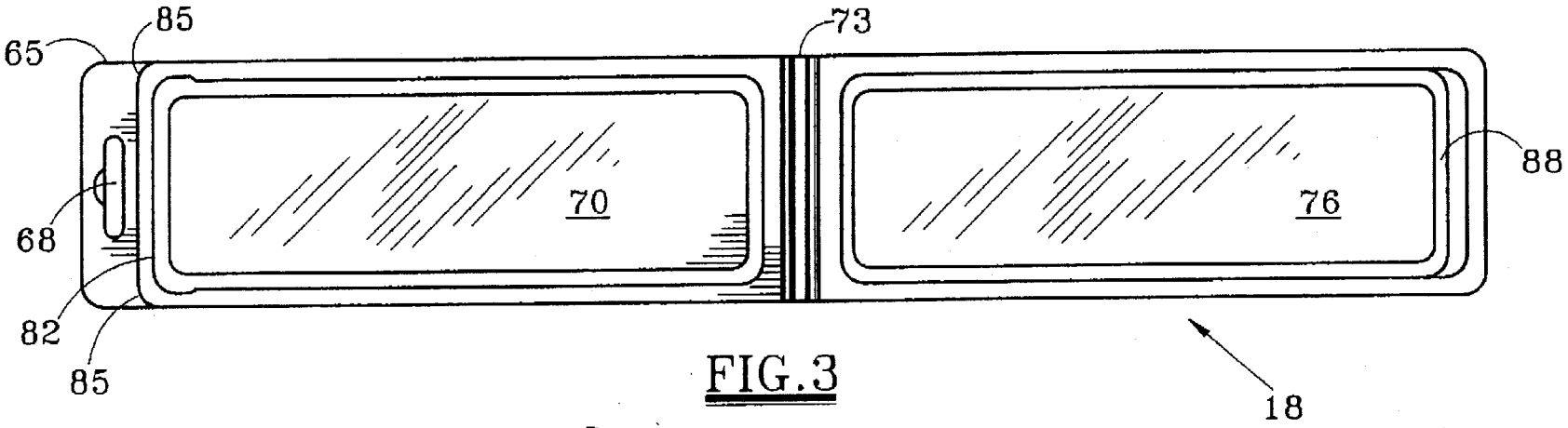
FIG. 3 is a plan view of the article of FIG. 2.

As best seen in FIGS. 3 and 5, the articles 18 have a tab 65, with an aperture 68. The aperture 68 is adapted to fit over a projection 36 on the back panel 24 of the header 15. The article 18 is attached to the header 15 by placing the projection 36 through the aperture 68 and pressing an indent 46 on a front panel 21 onto the projection 36, sandwiching the tab 65 between the front and back panels 21, 24. A horizontally elongated shape for the projection 36, aperture 68, and indent 46 is preferred to inhibit any tendency of the tab 65 to pivot about the projection 36 and to support the weight of the article 18.

Figure 2:
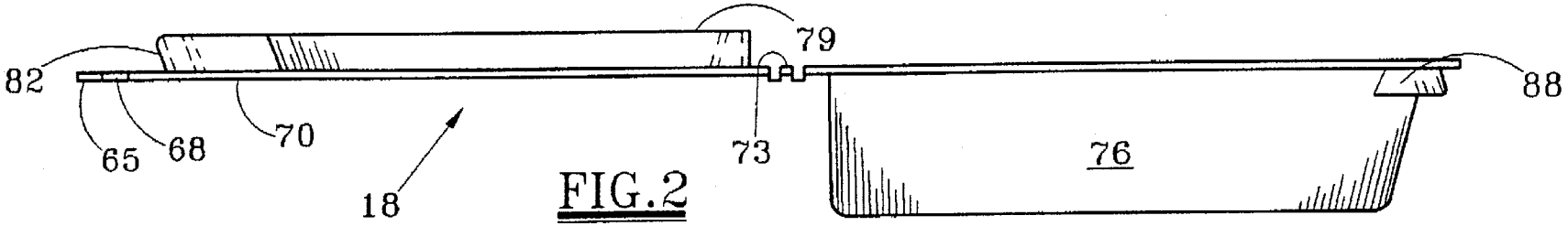
FIG. 2 is a side view of a fully open article which can be used with the header of FIG. 1.
Figure 4:
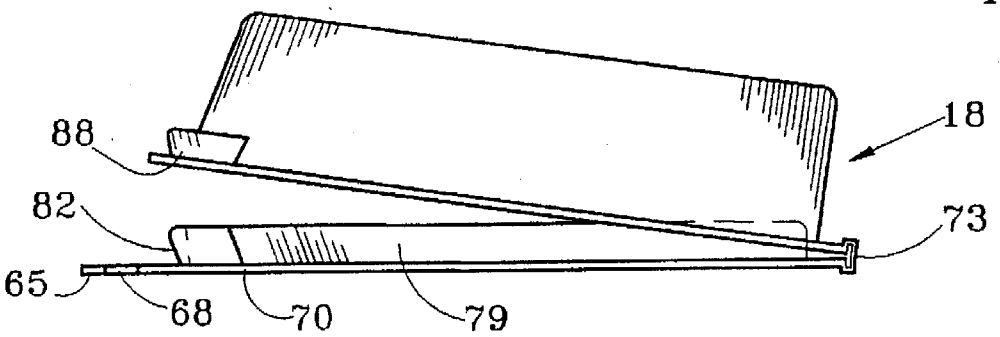
FIG. 4 is a side view of the article of FIGS. 2–3 shown partially closed.

In one preferred embodiment, articles 18*a*, 18*b*, and 18*c* are attached to the header 15, as shown in FIG. 6. Article 18 is preferably a clamshell container as best seen in FIGS. 2–4; but where desirable, the tab 65 can be affixed to another type of package such as a paper box, or directly to merchandise itself. The article 18 has a base 70, generally rectangular in shape. The tab 65 is formed at one end of the base 70 and, at an opposite end, a hinge 73 connects a box-shaped top 76. The base 70 has a ridge 79 facing the top 76 formed adjacent the perimeter of the base 70. The ridge 79 has a side 82 and preferably rounded corners 85 adjacent the tab 65 which are flared outwardly forming an acute angle with the base 70 at the tab 65.

The top 76 is open on the side facing the base 70. The end of the top 76 opposite the hinge 73 has a peripheral cavity 88 adapted to matingly receive the side 82 and corners 85 of the base 70 for interlocking the top 76 with the base 70. The cavity 88 has outwardly flaring walls so that mild force is required to snap the top 76 closed over the base 70. When the top 76 is pressed down on the base 70, the cavity 88 expands, and/or the side 82 and corners 85 contract, allowing the top 76 to snap into a closed and locked position over the base 70. The top 76 fits loosely around the outside of the ridge 79 in close proximity to the perimeter of the base 70, interlocked by the engagement of side 82 and corners 85 with cavity 88. An enclosure is defined by the base 70, the ridge 79, and the top 76 when the top 76 is in a closed and locked position over the base 70.

To assemble the unitized package assembly 10*a*, at least one object or component is placed on the base 70 or in the top 76 of an article 18. A printed sheet can also be placed in the top 76, if desired. The top 76 is closed onto the base 70, thereby containing the object(s) or component(s) inside the article 18. In a similar manner, objects or components can be enclosed in additional articles 18 having tabs 65.

The article 18 containing the merchandise is secured to a header 15 by placing the aperture 68 of the tab 65 over the projection 36 on the back panel 24 of the header 15, as best seen in FIG. 5. Additional articles 18 can be secured to the header 15 in a like manner. The printed sheet 62 is placed between the first and second raised surfaces 38, 48 of the header 15. The front panel 21 of the header 15 is pressed into an interlocking engagement with the back panel 24 of the header 15. The tabs 65 are secured between the projections 36 and the indents 46, and the printed sheet 62 is secured between the first raised surface 38 and the second raised surface 48. Fully assembled unitized package assemblies 10*a* are boxed and shipped to a retail outlet, where the unitized package assemblies 10*a* are unboxed and hung on a hook 49 for display at a point of sale, as shown in FIG. 7.

The unitized package assembly 10*a*, including the articles 18 and header 15, can be made of a thermoplastic, such as polystyrene, by conventional means. The articles 18 and header 15 are made of a material that provides sufficient stiffness so that shape is readily maintained, yet the material is flexible to allow the interlocking engagement described above. The material is preferably transparent so that the contents are visible.

The advantages of the unitized package assembly 10*a*, including the articles 18 and header 15, are numerous. A product having multiple components can be displayed at a point of sale, and the contents of the assembly are readily visible. Different combinations of optional components can be secured to a header 15 and displayed. Aggregates of articles can be packaged and sold together. Flexibility is provided in the combination of components and articles sold as a unit, and efficiency is provided in the speed and ease in which merchandise can be packaged.

Objects or components can be placed into articles 18 in an assembly step that is separate from the placement of the articles 18 onto the header 15. Thus, an article 18 can be packed and stored for later assembly onto a header 15. The flexibility of separate packing steps for various components is advantageous because it is simpler to package one component at a time into an article 18 and later assemble the articles 18 onto the header 15.

The versatility and adaptablility of the disclosed invention is particularly beneficial for merchandise distributors who purchase components from various manufacturers. Merchandise distributors can assemble various combinations of components and articles, depending on the market served. The printed sheet 62 can be customized, even the language used can be varied.

Although preferred and alternative embodiments of the invention have been disclosed and described, additional variations in the embodiments will become apparent to those skilled in this art. It is intended that all such variations within the scope and spirit of the appended claims be embraced thereby.

I claim:

1. A unitized package assembly, comprising:

a header including front and back panels extending downwardly from an upper flange to a lower flange;

a plurality of projections formed in the lower flange of the back panel of the header;

indents formed in the lower flange of the front panel to correspond with and receive the projections in locking engagement therewith;

a plurality of articles depending from the header;

a tab extending from each article including an aperture for receiving therethrough one of the projections from the lower flange of the back panel of the header to secure the tab extending from the article between the front and back panels.

2. The unitized package assembly of claim 1, wherein the upper flanges of the front and back panels have corresponding holes for receiving a display hook.

3. The unitized package assembly of claim 2, wherein the holes for receiving the display hook are adapted to center the unitized package assembly on the hook.

4. The unitized package assembly of claim 1, further comprising a printed sheet held between the front and back panels.

5. The unitized package assembly of claim 4, wherein the front and back panels have corresponding interengageable raised surfaces to define an enclosure between the upper and lower flanges to secure the printed sheet.

6. The unitized package assembly of claim 5, wherein the engagement of the raised surfaces locks the front panel to the back panel.

7. The unitized package assembly of claim 1, further comprising a hinge connecting the front and back panels of the header along an outer edge of the upper flanges.

8. The unitized package assembly of claim 1, wherein the projections, indents, and apertures are correspondingly shaped to restrict any pivoting of the tab about the projection.

9. The unitized package assembly of claim 8, wherein the projections, indents, and apertures are horizontally elongated.

10. The unitized package assembly of claim 1, wherein the articles are containers for displaying merchandise.

* * * * *